United States Patent [19]

Bentley

[11] Patent Number: 4,872,284

[45] Date of Patent: Oct. 10, 1989

[54] CELL BLOCK SECURITY SYSTEMS

[75] Inventor: Leroy Bentley, Covington, Ky.

[73] Assignee: Stewart Decatur Security Systems, Inc., Erlanger, Ky.

[21] Appl. No.: 272,468

[22] Filed: Nov. 17, 1988

[51] Int. Cl.[4] ..... E05B 47/00

[52] U.S. Cl. ..... 49/16; 49/13; 49/20

[58] Field of Search ..... 49/18, 20, 13, 14, 140, 49/15, 139, 16

[56] References Cited

U.S. PATENT DOCUMENTS

| | | | |
|---|---|---|---|
| 2,837,182 | 6/1958 | White | 49/18 |
| 3,343,302 | 9/1967 | Browning et al. | 49/18 |
| 3,913,263 | 10/1975 | Butt | 49/18 X |
| 4,190,985 | 3/1980 | Richards et al. | 49/16 |
| 4,621,451 | 11/1986 | Bruehler | 49/13 |
| 4,723,373 | 2/1988 | Jump | 49/20 X |

*Primary Examiner*—Philip C. Kannan
*Attorney, Agent, or Firm*—Kinney & Schenk

[57] ABSTRACT

A security system for detention cells is described. Known means are provided or lock to unlock the doors of all cells in a cell block. In combination with these means the present invention provides improved means for selectively unlocking the doors for individual cells in the cell block by either an electrical or a manual, "key" mode of operation. In all modes of operation the cell doors are locked when drop bars are in their lower positions and unlocked when the drop bars are raised to an elevated position. The selective unlocking means are characterized by latching means which prevent the drop bars from being raised. In the electrical mode, a motor driven cam disables the lever and raises the latching means and raises a given drop bar. In the "key" mode manually actuated means disable the latch means and raise the drop bar of a selected cell. The selective unlocking means are disclosed in combination with both sliding and pivotally mounted cell doors. Also the selective unlocking means is capable of installation where the cells in a cell block extend to either the right or left of a main control point.

10 Claims, 7 Drawing Sheets

60
54
7
58
56
52
101
77
76
20
84
78
28
80
57
70
66
74
72
68
99
98
118
30
32
116
96
59
97
59
48
50
46
40
7

54
58
56
60
52
101
84
77
57
76
66
78
70
80
94
72
74
28
46
97
98
68
84
99
96
116
32
59
118
59
48
50
40

58
54
66
56
52
101
77
84
76
78
80
57
28
74
70
40
72

CELL BLOCK SECURITY SYSTEMS

The present invention relates to improvements in cell block security systems and more particularly to improved means for selectively unlocking the doors to individual cells in a cell block.

It is a well established practice for detention cells to be disposed in rows, with a plurality of cells comprising a cell block. Cell block security systems provide means for either locking or unlocking all of the doors of the cells in the cell block. Further, such security means also provide means for selectively unlocking individual cell doors.

One well known security system comprises a master control bar which is mechanically shifted between a lock position and an unlock position. Intermediate positions of the master control bar permit individual cell doors to be selectively unlocked.

A drop bar is provided for each cell. In the lower position of the drop bar the door is locked. When the drop bar is raised to an elevated position the door is released so that it may be opened. In the lock position of the master control bar, means are provided for locking all of the drop bars in their lower positions, thus locking the doors in a closed position. In the unlock position of the master control bar, cam means thereon raise all of the drop bars to their elevated positions, thus unlocking all of the cell doors in the cell block.

Usually two means are provided for selectively unlocking individual cell doors. One means has an electric mode of operation and the other a mechanical, key mode of operation, the latter being provided primarily as a backup in the case of an electrical failure, or other malfunction in the components of the electric mode. These means are operative in intermediate positions of the master control bar.

While prior means for selectively unlocking individual cell doors are generally effective, they are relatively complicated and, consequently, relatively expensive.

The expense factor is also aggravated by the fact that the master control bar may extend toward the right or toward the left from the mechanism which displaces it between its lock and unlock positions. Because of this, many components of the selective unlocking means are left handed or right handed. Not only is there additional manufacturing costs in supplying "handed" parts, there is also additional cost in inventorying them.

A further shortcoming of prior selective unlocking means has been a relatively short service life.

The broad object of the present invention is to provide improved means for selectively unlocking individual cell doors in a cell block security system of the type referenced.

Another object of the present invention is to attain the above end and further to reduce the cost of such selective unlocking means.

A further object of the present invention is to simplify the mechanism for selectively unlocking individual cell doors and, concomitantly to improve the reliability and wear life thereof.

A more specific object of the present invention is provide means for selectively unlocking individual cell doors, which means can be emmployed for both right handed and left handed installations with few, if any, components unique to one hand or the other.

A further specific object of the invention is provide such selective door unlocking means which may be incorporated in existing security systems, and particularly the security system and electric circuit shown in U.S. Pat. No. 4,723,373.

The foregoing ends are attained in a security system of the type referenced wherein a master control bar is displaceable between lock and unlock positions in which drop bars are, respectively, locked in lower door locking positions and raised to elevated positions wherein the doors are unlocked. Selective means for unlocking individual cells are operable when the master control bar is in other than the lock or unlock positions and preferably when it is in an intermediate position.

The selectively actuated, unlocking means have, in association with the drop bar for each cell, means for latching the drop bar in its lower locking position. Motor operated cam means are provided for sequentially releasing the latching means and then raising the drop bar to its elevated release position. Preferably the cam means are rotated by a motor about an axis parallel to the movement of the master control bar.

Each drop bar may have a tab projecting therefrom, preferably centrally thereof. The latching means may comprise a latch member which pivots in a vertical plane, parallel to the direction of master control bar movement. The latch member has an arm which overlies the projecting tab and coacts therewith to latch the drop bar. Each cam means comprises a first plate element disposed generally normal to the motor shaft axis and a second plate element disposed generally radially of the motor shaft. This cam has an initial position wherein the first plate is disposed beneath and contiguous with the latch member arm and the second plate is disposed beneath and spaced from the drop bar tab.

A switch, engaged by the cam, may provide a signal to indicate that the cam is in its initial position. The motor, when actuated, rotates the cam through 180 degrees. During initial rotation of the cam, the first plate releases the latch member and then the second plate raises the drop bar to its release position so that that door is unlocked.

Each drop bar also may have a pin projecting therefrom for engaging a switch when the drop bar is in its lower position, thus providing a signal indicating that the cell door is in a closed position.

Alternate, manual means for selectively opening individual cell doors are provided so that individual cell door control can be maintained in the event of a power failure. These alternate means provide what is referenced as the key mode of opeation. The alternate means may advantageously employ, is association with each drop bar, a lever which is swung into engagement with the drop bar pin to raise the drop bar to its elevated, release position. Actuation of the lever is accomplished manually through the use of a key in what is referenced as the key mode of operation.

The key mode means also includes means for releasing the drop bar latch means. Preferably, these means take the form of an extension which projects, upwardly from each latch, adjacent the master control bar. Projections on the master control bar engage these extension, pivoting the latches to a release positions when the master control bar is shifted to its position for key mode operation. The same projections may also be employed to disable the latching means when to master control bar is shifted to its unlock position to permit the drop bars to be raised.

The cell block may include a transom disposed above the individual cells. The master control bar, the upper ends of the drop bars and the means for selectively unlocking the cell doors may be mounted on this transom. The latch is characterized in that in may be mounted on either the right or left hand side of the drop bar in operative relation with the drop bar tab. The cam motor is mounted on a bracket which, in turn can be mounted on either side of the drop bar with the cam positioned in operative relation to the tab and latch arm. The direction of rotation of the motor must be reversed when the motor is on one side as compared to the other. This can be accomplished by changing internal wiring in the motor. Alternatively different motors could be used.

The above and other related objects and features of the invention will be apparent from a reading of the following description of preferred embodiments of the invention, with reference to the accompanying drawings and the novelty thereof pointed out in the appended claims.

Detention cells take many forms. They may be defined by openwork grids formed by bars or they may be defined by solid walls. They have in common an entryway which is selectively closed by a door, which again may be an openwork grid or of solid construction. The doors may be slid or pivoted between open and closed positions.

Such detention cells are commonly arranged in rows referenced as cell blocks. Each cell block is provided with a security system having a plurality of settings. In one setting the doors of all cells are locked. In another setting, all of the cell doors are unlocked. In other settings, any selected cell door may be unlocked through the means provided by the present invention.

Figure 1:
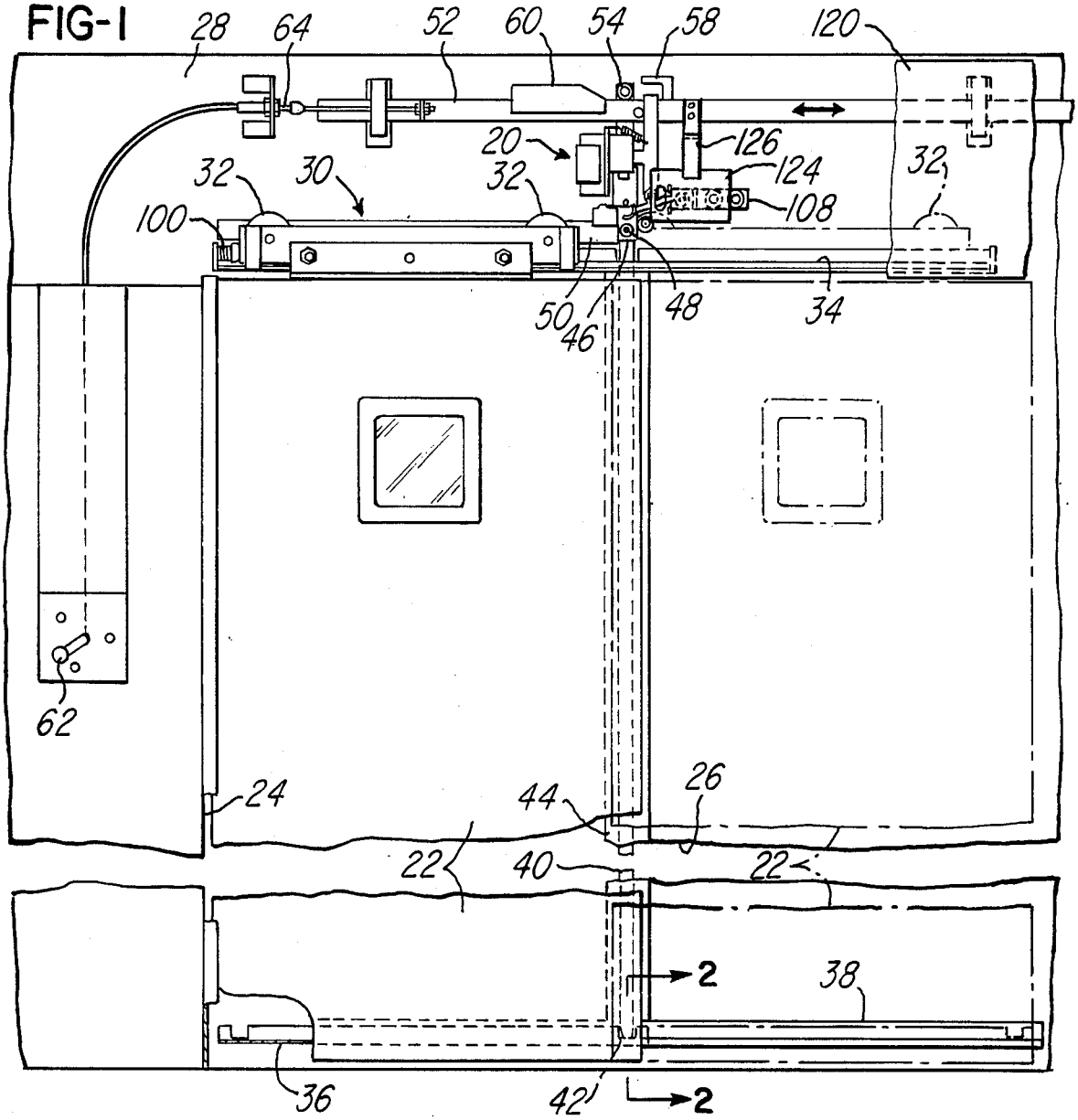
FIG. 1 is an elevation, with portions broken away, of a detention cell controlled by a security system incorporating the present invention.

FIG. 1 illustrates one cell of a cell block. The remaining cells of the block would be disposed to the right of the illustrated cell. The selective door unlocking mechanism is indicated generally by reference character 20. The cell has a door 22 which is slidable from its full line, closed position to an open position indicated by phantom lines. The entryway to the cell is defined by walls 24 and 26.

The mechanism 20 is adapted to cooperate with the components of preexisting security systems, as are partially shown in U.S. Pat. No. 4,723,373. This prior environment will first be described.

A transom 28, in the form of a steel plate, is disposed above the entryway and provides structural support for various mechanisms. The transom, in composite form, extends through the length of the cell block. The door is suspended from a trolley 30. The trolley 30 has grooved wheels 32 which ride on a rail 34. The rail 34 is mounted on and projects outwardly from the transom 28.

Figure 2:
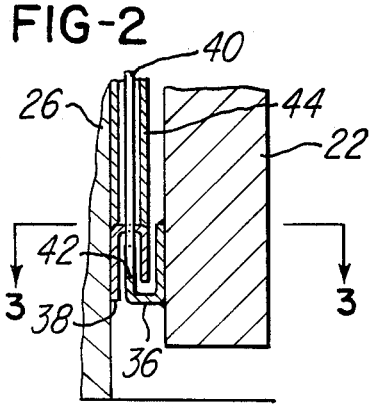
FIG. 2 is a section, on an enlarged scale, taken on line 2—2 in FIG. 1.
Figure 3:
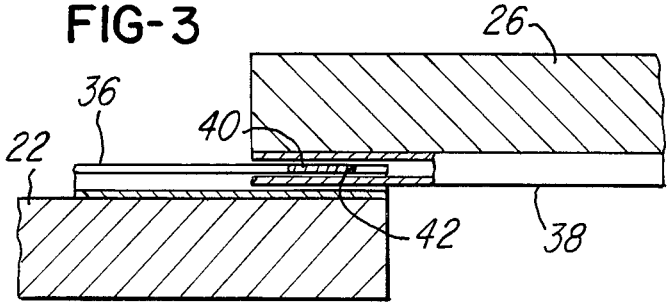
FIG. 3 is a section taken on line 3—3 in FIG. 2.

An upwardly open U channel 36 is secured to the inner surface of the door 22, along its lower end. A downwardly open U channel 38 is mounted on the outer surface of the wall 26. As indicated in FIGS. 2 and 3, these channels interdigitate. The lower end of the door 22 is secured against movement, in a locked position, by a drop bar 40 which extends through an opening in the bridge of channel 38 and is received by a notch 42 in one leg of the channel 36. The drop bar 40 is slidable in a housing 44 which is mounted on the wall 26 at the right side of the cell entryway. The housing 44 extends upwardly to the transom 28.

Figure 4:
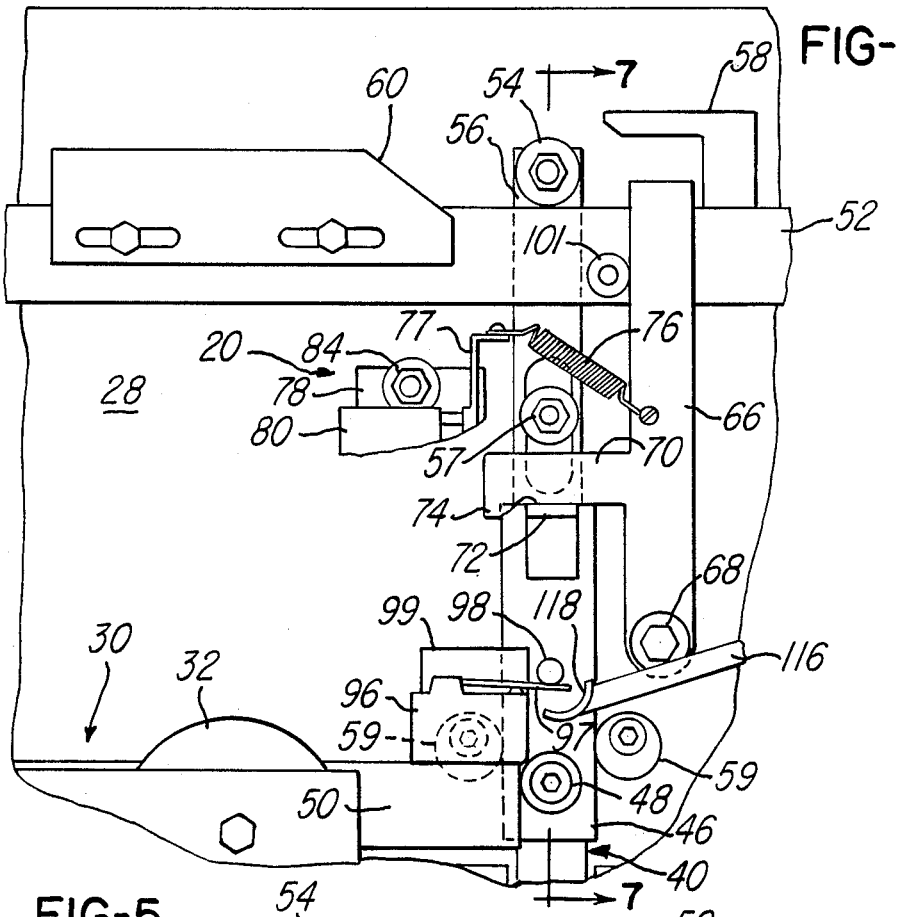
FIG. 4 is an elevation, on an enlarged scale of selective door opening mechanism seen in FIG. 1 and illustrating an "electric" mode of operation.

At the upper end of the drop bar there is a drop bar extension 46 from which a roller 48 projects, see also FIG. 4. In the locked position, the roller is disposed in the path of travel of one end of a horizontal bar 50, mounted on the trolley 30, thereby locking the upper end of the door from opening movement toward the right.

To unlock the door 22, the drop bar 40 is raised to release its lower end from the notch 42 and elevate the roller 48 above the bar 50 to release the door. The door 22 may then be opened by displacement toward the right.

A master control bar 52 is mounted on the transom 28 for sliding movement. A roller 54 mounted on a bar 56, which extends upwardly from the drop bar extension 46, cooperates with the master control bar 52 in the locking and unlocking of the door 22. The bar 52 extends to the right to similarly control the doors of the other cells in the cell block.

At this point it will be noted that the bar 56 and extension 46 are structural components of the drop bar 40 and that the latter term encompasses these composite components. It will also be seen that a shoulder stud 57 extending through a slot formed in the bar 56 and rollers 59 guide and constrain the upper end of the drop bar for vertical reciprocating movement.

Figure 6:
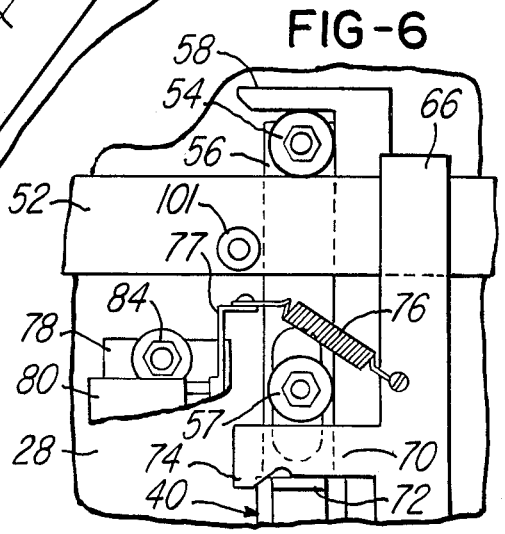
FIG. 6 illustrates the security system in a "lock" setting.

The master control bar 52 has four operational positions, or settings. In one extreme position, illustrated in FIG. 6, a hook 58, secured to the bar 52, overlies the roller 54 and prevents upward movement of the drop bar 40. Thus the illustrated cell door 22, and all other cell doors in the cell block are positively locked and secured against being opened.

Figure 5:
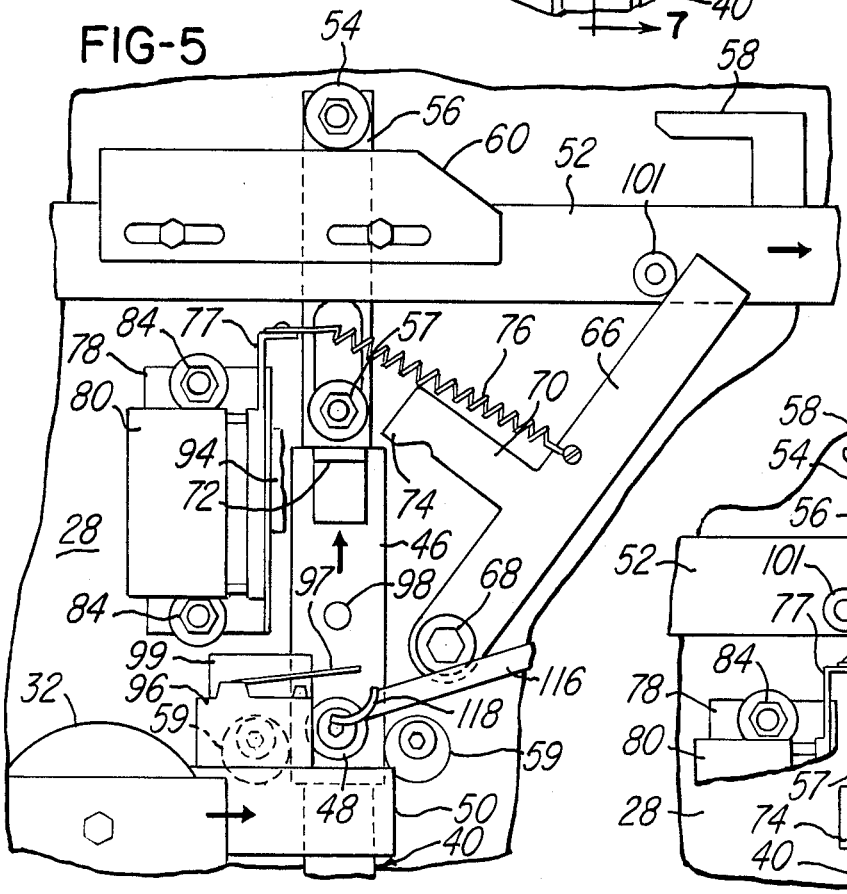
FIG. 5 illustrates the security system in a cell block "unlock" setting.

The other extreme position of the master control bar 52 is illustrated in FIG. 5. In this position the roller 54 has been raised to an elevated position by a cam 60, also secured to the bar 52. The roller 48 is raised above the trolley bar 50 and the lower end of the drop bar is raised from the notch 42, thereby releasing the door 22 for opening movement. The doors of the other cells in the cell block are similarly unlocked.

Movement of the master control bar 52 is regulated by a lever 62 mounted on the wall 24. Through an appropriate mechanical connection, as a rack and pinion, pivotal movement of the lever 62 is transmitted to a curved cable 64 (disposed within an appropriate cable sheath) and then to the master control bar 52.

As described, in one extreme position of the master control bar 52, the door 22 and all doors in the cell block are positively locked in a closed position. In the other extreme position the door 22 and all doors in the cell block are unlocked. The master control bar 52 has two intermediate positions wherein the selective unlocking mechanism 20 permits opening any given cell in the cell block, either manually or by remote electrical means, respectively referenced as "key" and "electric" modes of operation.

The mechansim associated with electric mode operation is best shown in FIGS. 7–12. Referencing FIGS. 7 and 10, a flat latch 66 is pivotally mounted, by bolt 68, on a lug 69 projecting from transom 28. Latch arm 70 overlies a tab 72 provided by an angle which projects from the drop bar extension 46. Latch arm 70 has a projection, or hook 74, at its outer end which extends beneath the tab 72. The sloped surface of the hook 74 latches against the tab 72 to prevent upward, releasing movement of the drop bar 40. The configuration of the hook 74 permits it to be swung to an unlatched position when the cell door is to be opened. A spring 76 extends between the latch 66 and a tab 77 on a bracket 78 to yieldingly maintain the latch in its locking position.

As will be seen the latch 66, in the electric mode of operation, provides the only restraint against upward, releasing movement of the drop bar 40. When it is desired to open a single cell door, a motor 80 is energized to rotate a cam 82. The bracket 78 is compositely formed and is mounted on the transom 28 by bolts 84. The motor 80 is mounted on the composite bracket 78.

The present selective unlocking mechanism is adapted for operation by the electrical circuit found in the referenced U.S. Pat. No. 4,723,373. It incorporates switches found in that circuit, as will later appear. Briefly, the electrical control mechanism is located at a remote location. It includes a switch for each cell in the cell block. When the switch for a given cell is actuated, the motor 80 is energized and that cell door will be unlocked as will now be described.

Figure 7:
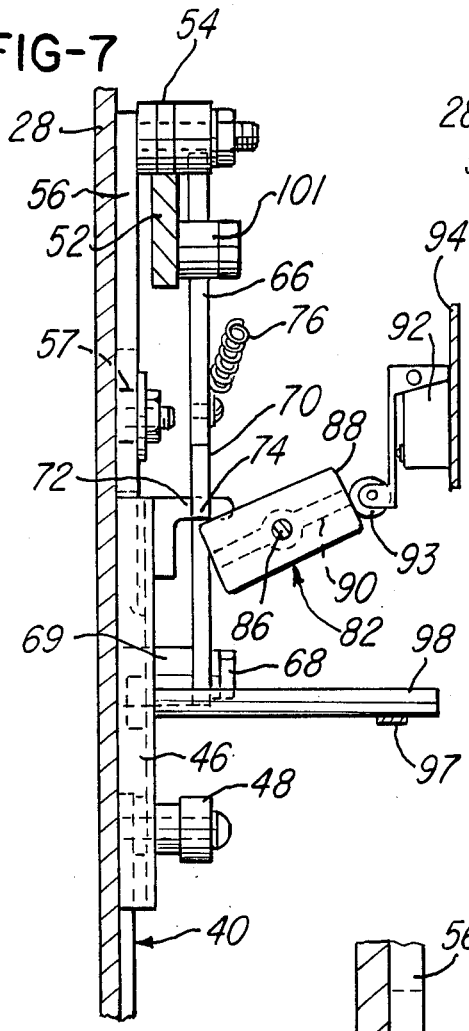
FIG. 7 is a section, on a somewhat greater scale, taken on line 7—7 in FIG. 4.
Figure 10:
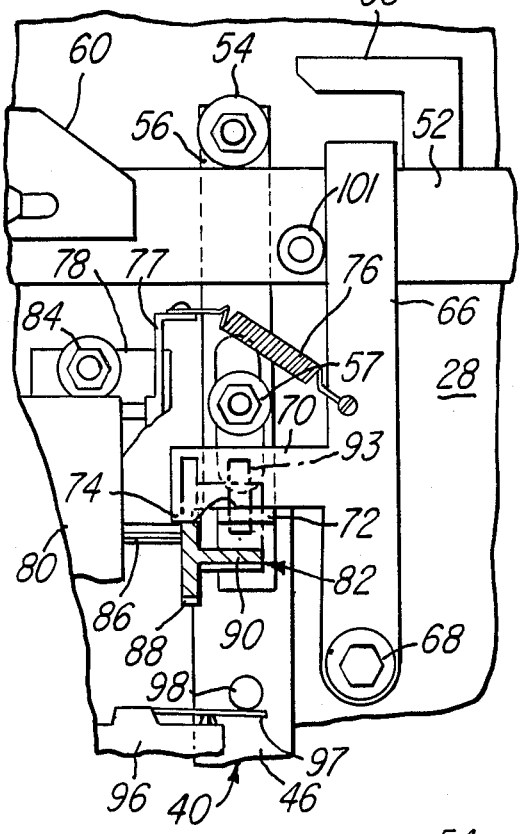
FIG. 10 is an elevation of the locking mechanism in its position as seen in FIG. 7.

The locked relation of the mechanism 20 in its "electric" mode is illustrated in FIGS. 7 and 10, with the latch 66 engaged. The cam 82 is secured to the motor shaft 86 and generally underlies the latch arm 70. The cam 82 comprises a first plate element 88 disposed normal to the cam axis and a second plate element 90 disposed radially of the cam axis. In this initial, or rest, position, the plate 88 underlies and is contiguous with the latch arm hook 74 and the plate 90 underlies and is spaced from the drop arm tab 72.

It will also be noted that, in this rest position, a switch 92 is actuated by engagment of one side of the cam plate 90 with a switch roller 93. The switch is mounted on a panel 94 secured to the bracket 78. A switch 96 is mounted on the motor bracket 78 to provide a signal reflecting that the drop bar 40 is in its lower, locking position. The switch 96 is actuated by engagement of a lever 97 with a pin 98 projecting from the drop bar extension 46. The switch 96 is mounted on a bracket panel 99 which is also a composite part of the bracket 78. (The switches 92 and 96 correspond to the switches 178, 182 in the electrical control circuit of Pat. No. 4,723,373.)

When it is desired to open a single cell, the motor 80 is energized by an appropriate remote switch. The cam 82 then rotates in a clockwise direction, through 180 deg. as limited by reacturation of the switch 92.

Figure 8:
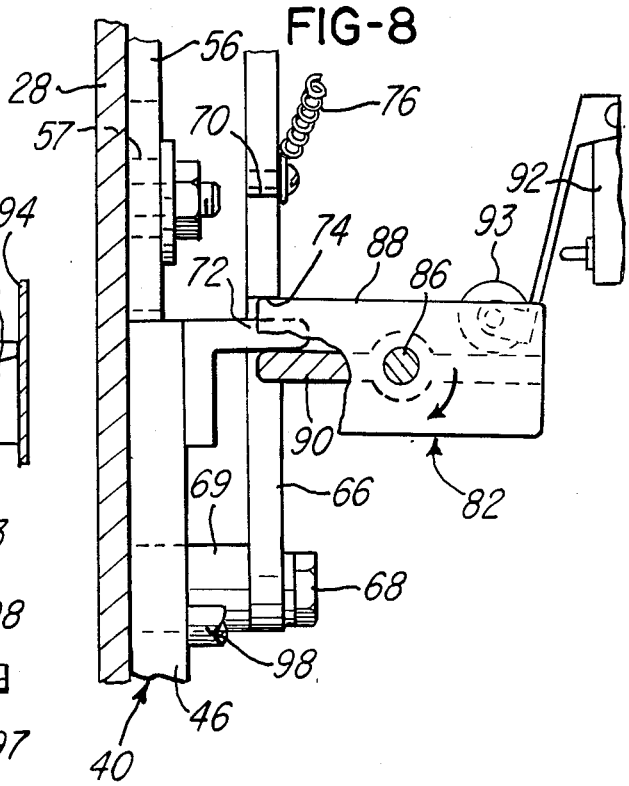
FIGS. 8 and 9 are sections, on an enlarged scale, similar to FIG. 7, illustrating operation of the present mechanism in its "electric" mode.
Figure 9:
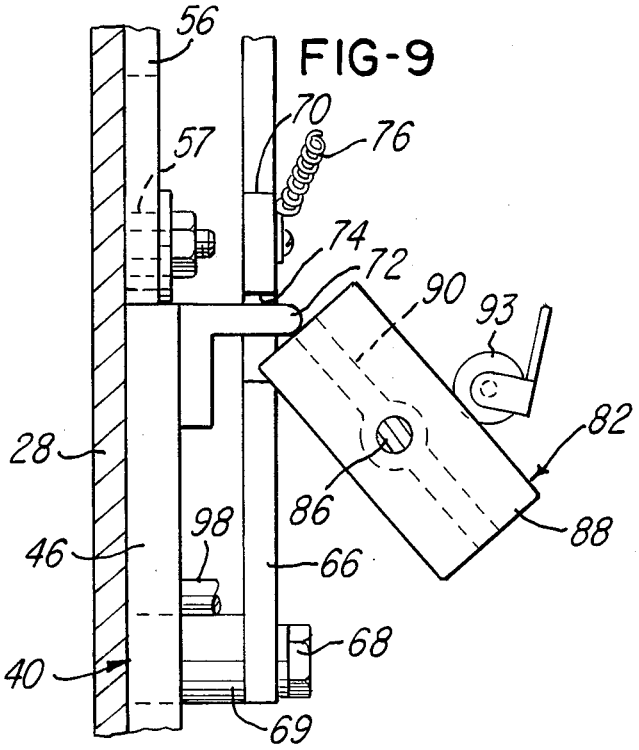
Figure 11:
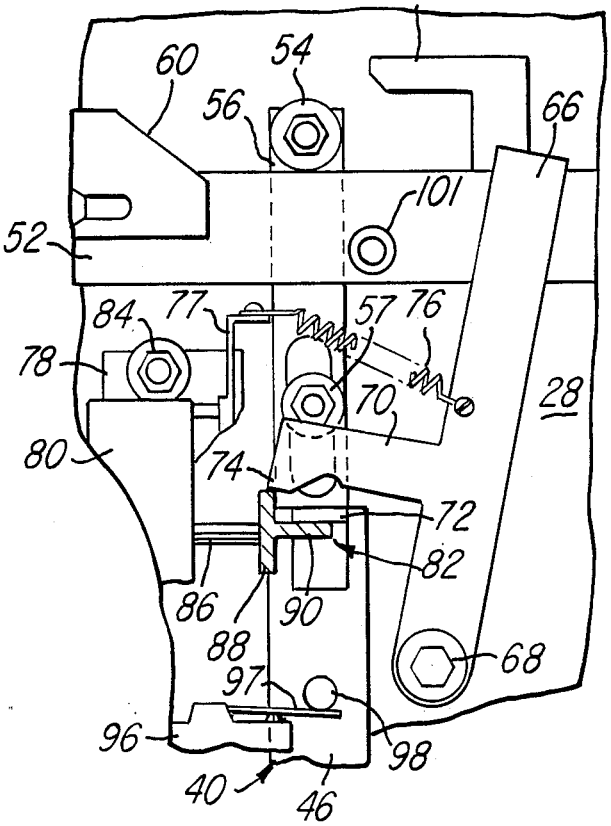
FIG. 11 is an elevation of the locking mechanism in its position as seen in FIG. 8.
Figure 12:
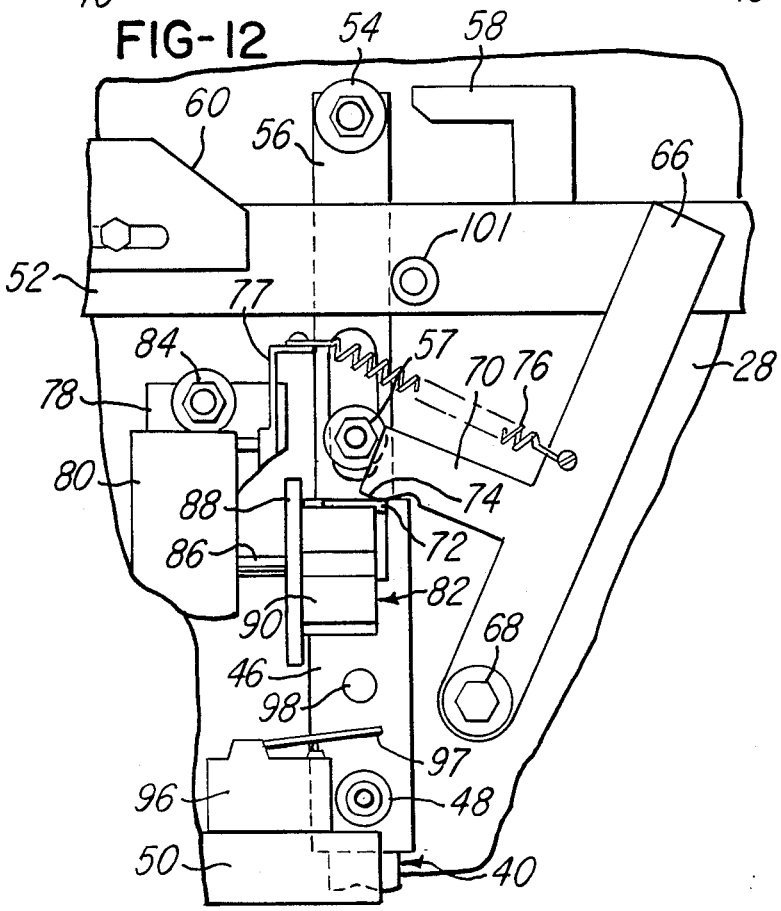
FIG. 12 is an elevation of the locking mechanism in its position as seen in FIG. 9.

During initial rotation of the cam 82, to the position of FIGS. 8 and 11, the plate 88 releases the latch 66 and spaces the latch arm 70 above the tab 72. At the same time, the second plate 90 is brought into contiguous relation with and beneath the tab 72. Further rotation of the cam 82, to the position of FIGS. 9 and 12, then results in the drop bar extension 46, and the drop bar 40 being raised to a release position. In the release position the lower end of the drop bar 40 is withdrawn from the notch 42. Also the roller 48 is elevated above the trolley bar 50. The door 22 is then free to be slid to an open position.

Preferably, a spring 100 (FIG. 1) is provided at the left end of the rail 34. In the locked position of the door 22, the spring 100 is compressed by the trolley 30. When the drop bar 40 is raised to its release position, the spring 100 displaces the door to the right so that it is ajar. When the door is thus displaced, the trolley bar 50 is disposed beneath the roller 48. Thus when the cam 82 continues its rotation from the position of FIGS. 9 and 12 to the rest position illustrated by FIGS. 7 and 10, the drop bar 40 is maintained in its release position. When the cell is to be secured, the door is manually displaced to its leftmost position, wherein the drop bar 40 again falls to its locking position. The door cannot then be reopened except by reactuation of one of the unlocking means herein provided.

Opening of selected, individual cells in a cell block is normally accomplished by the above described "electric" mode of operation. An alternate "key" mode is also provided to open individual cells in the event of an electrical failure, or other malfunction. The portions of the mechanism 20 which provide this function are particularly illustrated in FIGS. 13–16.

Figure 13:
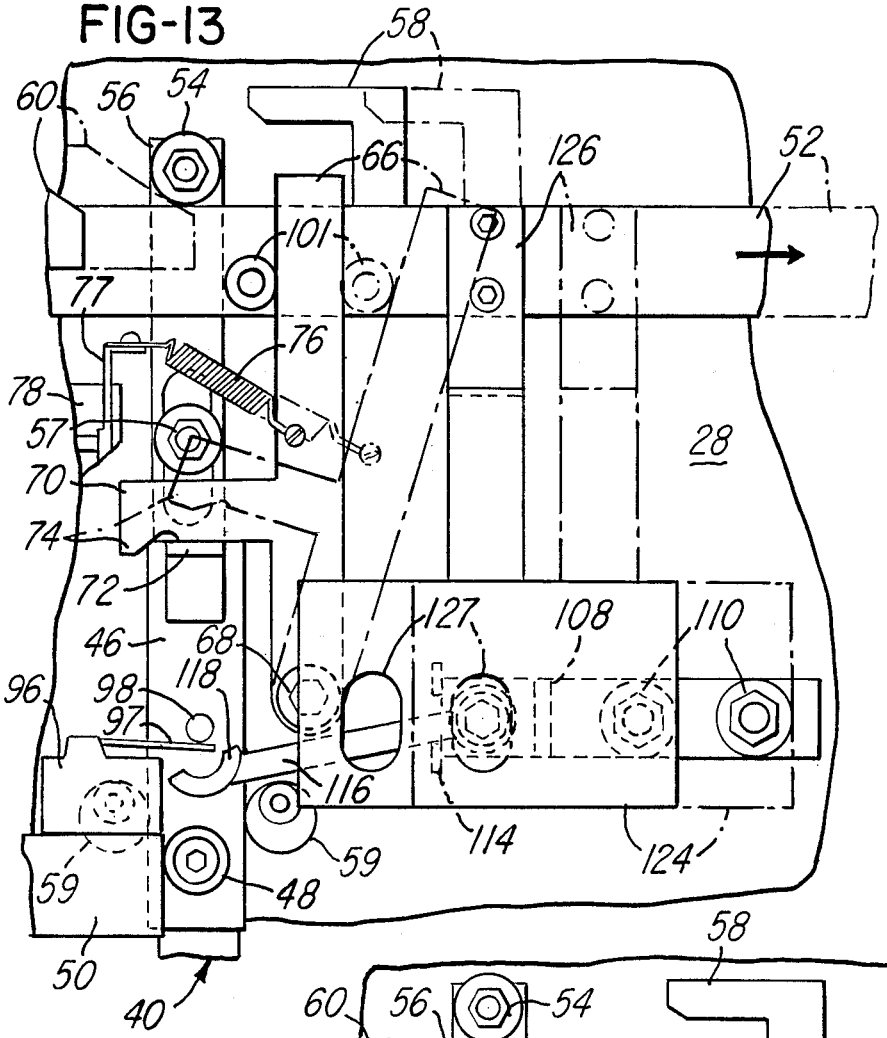
FIG. 13 is an elevation of the locking mechanism illustrating a "key" mode of operation.
Figure 14:
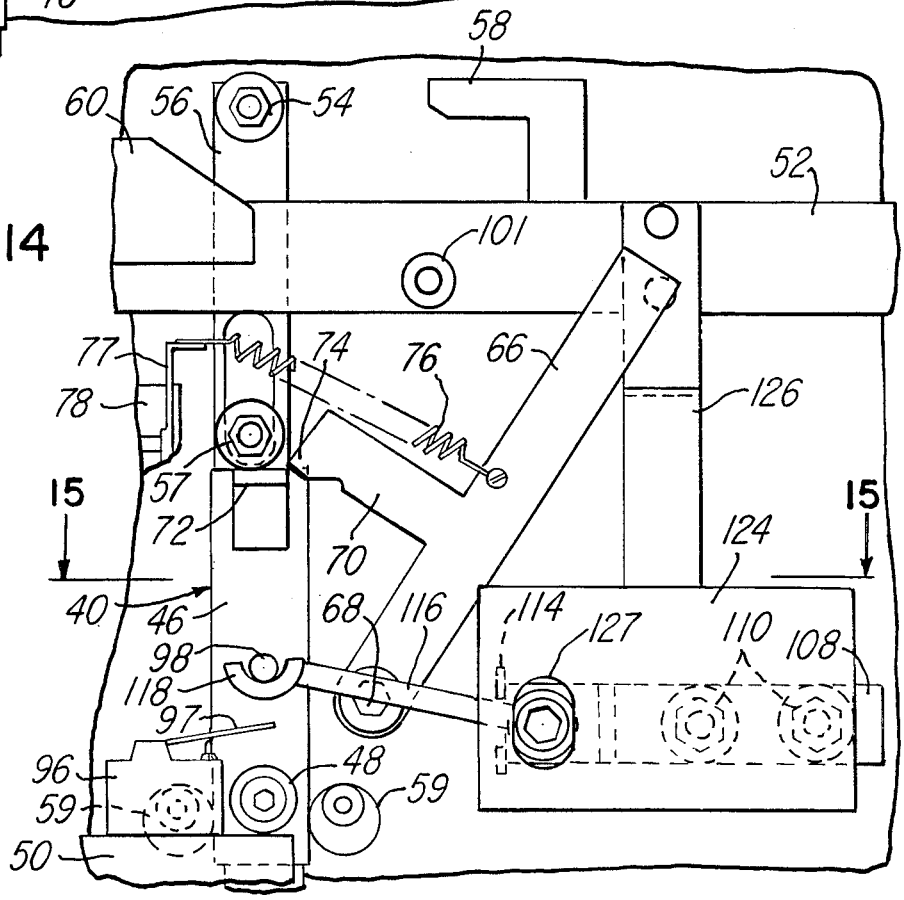
FIG. 14 is an elevation similar to FIG. 13, illustrating the released position of the "key" mode.
Figure 15:
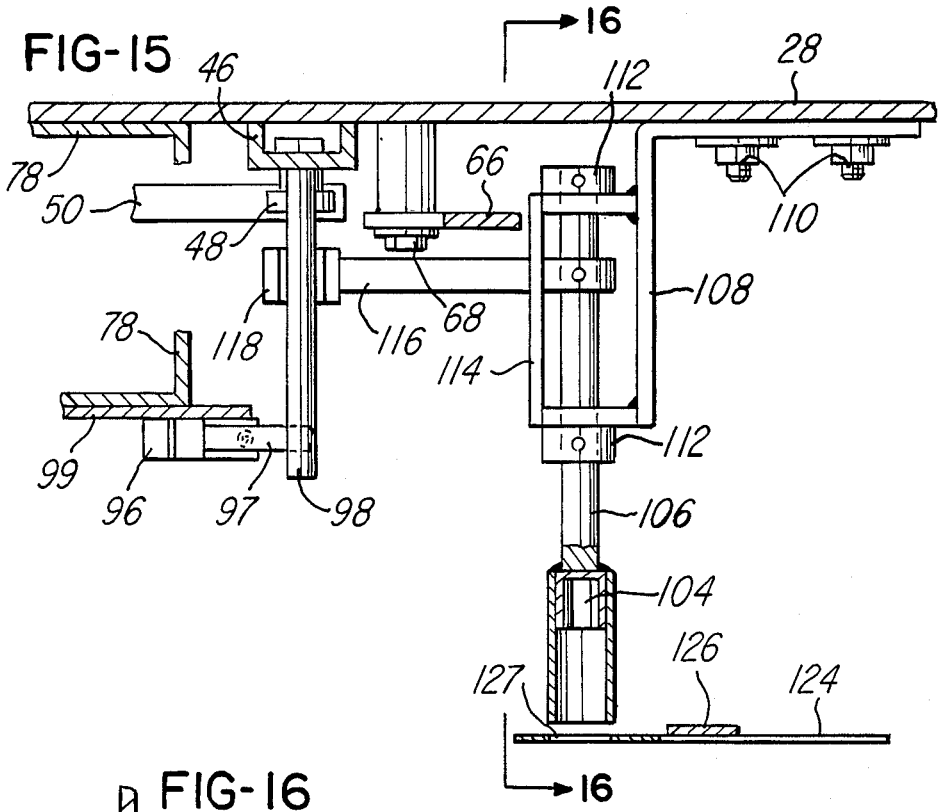
FIG. 15 is a section taken on line 15—15 in FIG. 14.

In the "key" mode, the master control bar 52 is displaced, by lever 62 (FIG. 1), from the full line electric mode setting, FIG. 13, to the phantom position illustrated therein. When the master control bar 52 is moved to the "key" mode position, the latch 66 is disabled by a projection, or roller 101 engaging an upward extension of the latch 66 and pivoting it to the phantom position seen in FIG. 13. The drop bar 40 and drop bar extension 46 are thus free to be displaced upwardly and permit opening of the door 22. It will also be noted that the roller 101 displaces the latch 66 to a release position when the master control bar 52 is moved to its position for opening all of the doors in a cell block, as illustrated in FIG. 5.

The "key" employed for this mode of operation may simply take the form of a torquing member of hexagonal cross section, in the nature of an Allen wrench. It is inserted into a hexagonal socket formed in the end of a shaft 106. The shaft 106 is mounted on a bracket 108, which, in turn, is secured to the transom 28 by bolts 110. The shaft 106 is axially positioned relative to the bracket 108 by collars 112. The shaft receiving arms of the bracket 108 are reinforced by straps 114.

A lever 116 is secured to the shaft 106 and projects between the straps 114 which also limit its pivotal movement. A tubular segment 118 is provided at the outer end of the lever 116.

Figure 16:
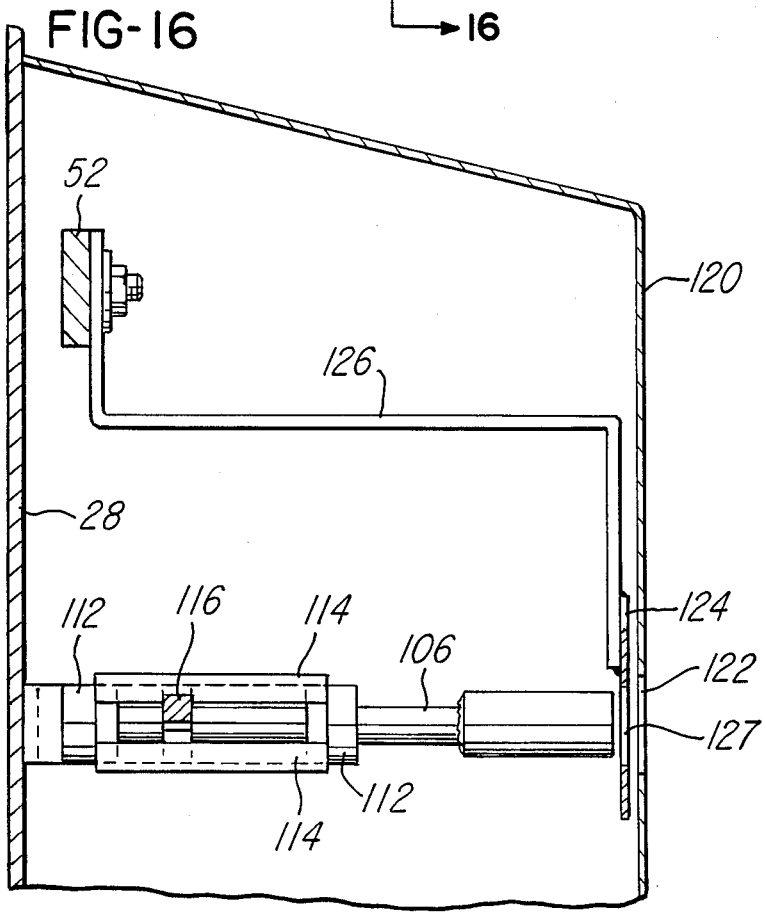
FIG. 16 is a section taken on line 16—16 in FIG. 15.

At this point it will be noted that it is accepted practice to enclose the security system mechanism, mounted on the transom 28, behind paneling in order to prevent tampering. The paneling is illustrated in FIG. 16 and identified by reference character 120. A fragmentary portion of the paneling is also shown in FIG. 1.

An opening 122 (FIG. 16) is provided in the paneling 120, in alignment with the key socket 104. In all positions of the master control bar 52, other than the "key" mode, access to the socket 104 is blocked by a baffle plate 124 which is secured to the master control bar 52 by a bracket 126. When the master control bar 52 is in the "key" mode position, an opening 127, in the baffle 124, is brought into alignment with the socket 104 and the paneling opening 122. A key may then be inserted into the socket 104 to manually open a selected cell door.

To open a door, the shaft 106 is rotated by a key to swing the tubular end 118 of lever 116 into engagement with the pin 98. The concavely curved upper surface of the tubular section minimizes lateral forces on the pin 98 when the drop bar is being raised. As previously indicated, the latch 66 has been displaced to an unlocked position by roller 101 on the master control bar 52. The drop bar extension 46 is thus free to be displaced upwardly, by the lever 116, to an elevated release, or unlocking, position, illustrated in FIG. 14. Again, the door is displaced to a partially open position by the spring 100, bringing the trolley bar 50 beneath the roller 48.

Figure 17:
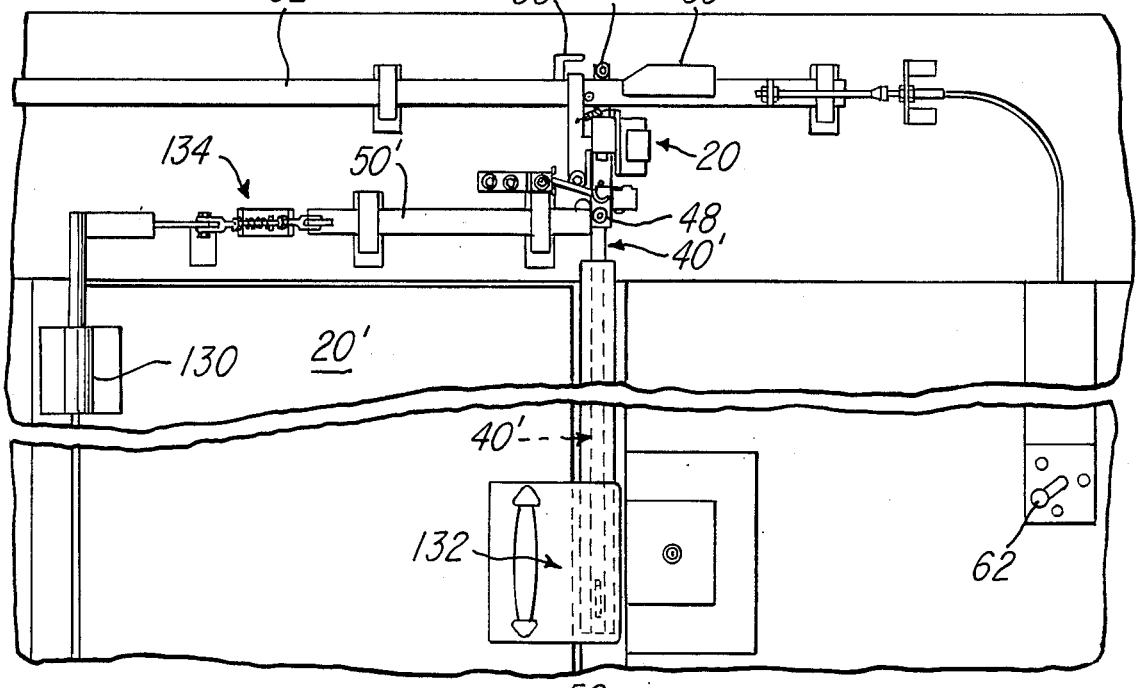
FIG. 17 is an elevation, with portions broken away, of a security system incorporating the present selective unlocking mechansim controlling movement of a pivoted, detention cell door, and further illustrating a reversible feature of the invention.
Figure 18:
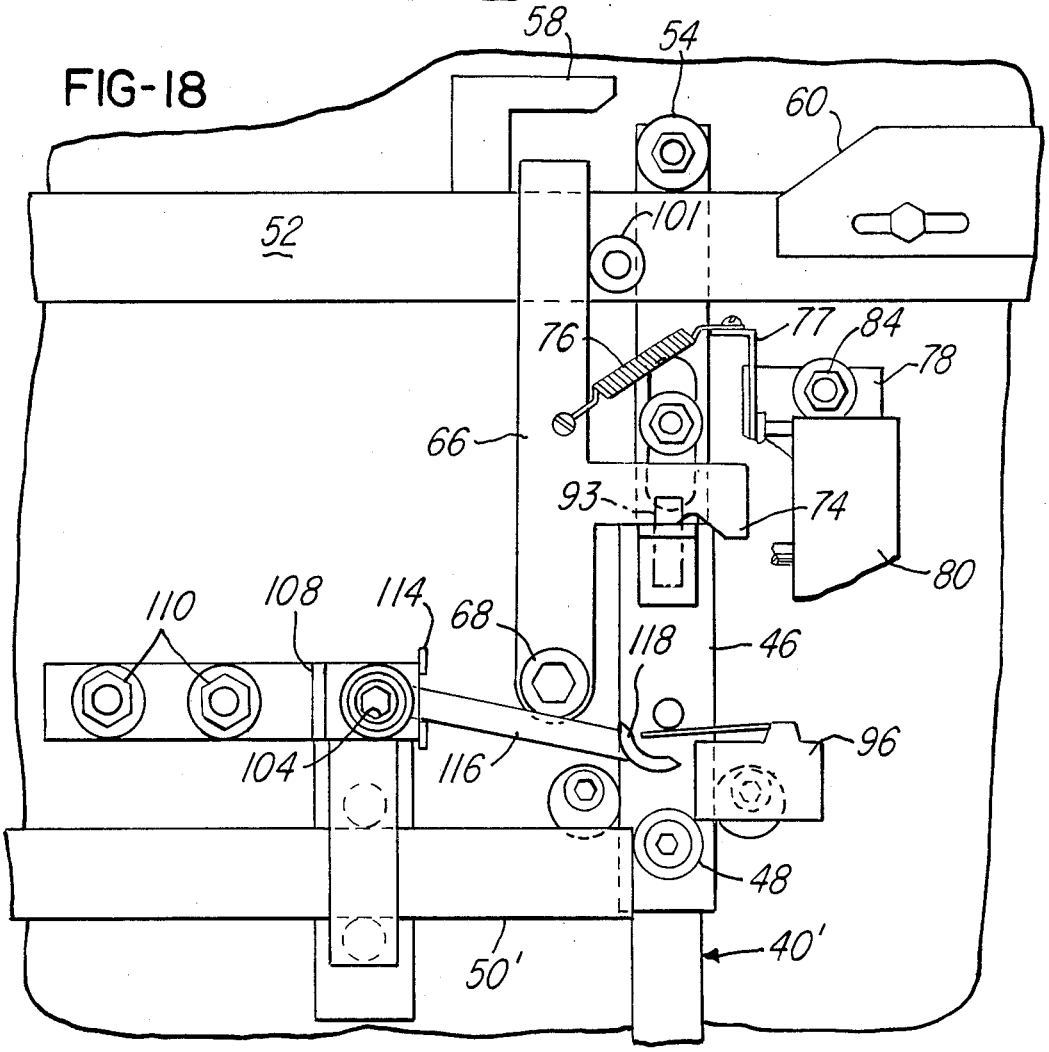
FIG. 18 is an enlarged elevation of the locking mechanism seen in FIG. 17.

Reference is next made to FIGS. 17 and 18 for an alternate application of the present invention.

As indicated above, detention cells take many forms. FIGS. 17 and 18 illustrate a detention cell having a pivotally mounted door. Again, the illustrated cell would be one cell in a cell block of several cells, the doors of which are to be controlled in the same fashion as described above. These Figures illustrate another difference in that the remaining cells in the cell block extend to the left of the illustrated cell, whereas the cells of the cell block extend to the right of the cell illustrated in FIG. 1.

In previous selective door unlocking mechanisms, right and left hand units had few common parts. Not onlly does this involve greated manufacturing expense, with lower production volume, it also meant a greater inventorying expense due to the larger number of parts unique to the left or right hand units.

The mechanism 20, dependent on its mode of installation, can be used for either right or left hand installations. In the left hand installation now to be described, a door 20' is pivotally mounted on hinges 130.

The door 20' is locked by a modified drop bar 40' when it is in its lower position. The drop bar 40' may be connected to the same drop bar extension 46. Two door locking means are likewise provided. Thus, in the lower, locking position of the drop bar 40', its lower end engages latching mechanism 132 and prevents its release. The second means comprises a locking bar 50' corresponding to the trolley bar 50. The bar 50' is a component of existing mechanism 134 which displaces the bar 50' to the right when the door 20 is swung to an open position. Movement of the bar 50' to the right is prevented by the roller 48 when the drop bar 40' is in its lower position.

As in the previously described security system for sliding cell doors, the drop bar 40' must be raised to an elevated, release position in order to open the cell door.

The master control bar 52 may have the same cams 60 and hooks 58 which cooperate with the drop bar rollers 54 of the several mechanisms 20 to lock all cell doors when the master control bar 52 is in one extreme position and to raise the drop bars 40' and unlock all of the cell doors, when the master control bar is in its other extreme position. The master control bar may be longitudinally positioned by the same manually operated means including lever 62.

The components of the mechanism 20 which cooperate with the drop bar components are, for the most part, simply mounted on opposite sides thereof. These components are identified by the same reference characters as before. Some components are simply identified by reference characters without specific written description where the same function is provided, as above.

At each cell, the latch 66, being planar, is readily mounted on a lug to the left of the drop bar extension 46. The roller 101 is mounted on the master control bar 52 to coact with the upper extension of the latch and disable it in the "key" mode and in the unlock position of the master control bar.

The bracket 78 is rotated 180 degrees and mounted on the right side of the drop bar extension 46. The cam 82 is thus disposed in the same operative relation with the tab 72 and the latch hook 74. The horizontal disposition of the axis of cam 82, parallel to the direction of movement of the master control bar, facilitates the ability of the mechanism to be used for either right or left hand installations.

The direction of rotation of the motor 80 requires reversal. This can be done by switching internal wiring in the motor, according to known practices, or, if desired, a different motor with a counterclockwise rotation can be employed. The sensing switches 92 and 96 are rotated 180 degrees relative to the bracket 78 to bring them into the same relative positions with respect to the cam plate 90 and the pin 98. Similarly, the tab 77 is secured to what is now the upper end of the bracket 78 to provide an anchor for the spring 76.

The "key" mode mechanism is similarly adapted for reversal. The bracket 108 is mounted to the left of the drop bar extension 46, The lever 116 is reversed on the shaft 106 so that the concave surface of the tubular section is engageable with the pin 98. The key socket baffle (124), not illustrated in FIGS. 17 and 18, would be appropriately mounted on the master control bar 52 and the access opening therein and in the outer paneling to limit access to the key socket.

It will be apparent that operation of the mechanism 20 is identical in either right or left hand installations, with provision for different directions of rotation of the motor 80. In the "electric" mode, actuation of a remote switch, corresponding to the cell door to be opened, causes the cam 82 to first disable the latch 66 and then raise the drop bar 40 or 40' to its elevated release position. Likewise, in the "key" mode position of the master control bar, the lever 116 may be swung to engage the pin 98 and raise the drop bar 40 or 40' to its elevated, release position.

The described mechanism for selectively unlocking detention cell doors is particularly adapted to coact with the referenced existing security system. It could also be employed with other security systems which attain similar ends. Further, this mechanism could be employed in security systems where dorrs to other than detention cells are controlled. These and other variations from the preferred embodiment herein described will occur to those skilled in the art, within the scope and spirit of the present invention concepts set forth in the following claims.

Having thus described the invention, what is claimed as novel and desired to be secured by Letters Patent of the United States is:

1. In a security system for a cell block wherein each cell door is locked by a drop bar when it is disposed in a lower position and unlocked when the drop bar is in an elevated, release position, and the system comprises a master control bar having means, effective in a lock position thereof, to lock all of the drop bars in their lower positions, and means, effective in an unlock position of the master control bar, to displace all of the drop bars to their release positions, and selectively actuable, door unlocking means for raising each drop bar, said selectively actuable means being operable when the master control bar is in other than its lock or open positions, and comprising, in association with each cell, means for latching the drop bar in its lower, locking position, and cam means for sequentially releasing said latch means and then raising the drop bar to its elevated, release position.

2. In a security system as in claim 1 wherein the master control bar is horizontally reciprocatable between its lock and unlock positions and the drop bars are vertically receprocable between their locking and release positions, each drop bar has a roller projecting from its upper end, the drop bar locking means comprise hooks respectively overlying the drop bar rollers in teh lock position of the master control bar, and the drop bar displacing means comprise cams respectively engaging said rollers as the master control bar is moved to its unlock position, the selectively actuable unlocking means are operable when the master control bar is shifted to a position wherein the drop bar rollers are intermediate the hooks and cams, and said cam means is rotatable about a horizontal axis parallel to the movement of said master control bar.

3. In a security system as in claim 2 wherein the selectively actuable unlocking means each include a tab projecting from said drop bar, the latch means include a latch member pivotal in a vertical plane parallel to the direction of movement of the master control bar, and having an arm overlying said tab, and a motor rotating said cam means through 180 degrees upon each actuation of the selective opening means, said cam means being engageable with said tab to raise the drop bar to its release position.

4. In a security system as in claim 3 wherein, for each selectively actuable unlocking means, the latch is pivoted about an axis disposed beneath the tab and has an extension projecting upwardly into contiguous relation with the master control bar, and further wherein the master control bar has projections thereon which, respectively, engage said latch extensions and disable said latch means upon the master control bar cams raising the drop bars to their release positions.

5. In a security system as in claim 4, wherein each cam means comprise a cam secured to the shaft of said motor and each cam is symmetrical relative to the motor shaft axis and comprises a plate element disposed normal to the motor shaft and engageable with said latch arm and a second plate element disposed generally radially of the motor shaft, said cam having an initial position wherein the first plate is contiguous with said latch arm and the second plate is disposed beneath and spaced from the drop bar tab.

6. In a security system as in claim 5 wherein each selective unlocking means further include a switch alternately engaged by opposite sides of the second, radial cam plate to provide a signals indicating that the cam is in a rest positions.

7. In a security system as in claim 6 wherein a pin projects from each drop bar and switches are respectively provided for engagement by said pin when the drop bars are in their lower positions, to provide a signal indicating that each cell door is secured or not secured.

8. In a security system as in claim 7 further including, in association with each cell, alternate manual means for selectively unlocking each cell door, said alternate means comprising means for disabling said latch means, a pivotally mounted lever having its outer end disposed beneath said pin and means for manually rotating said lever to engage said pin and raise the drop bar to its elevated, release position.

9. In a security system as in claim 7 wherein a transom is generally vertically disposed above the cell doors, the master control bar, and the upper end of the drop bars are mounted thereon and said tabs respectively project centrally from the drop bars, said latches are pivotally mounted on the transom and are characterized in being planar permitting the pivot axes therefor to be disposed on the right or left hand side of the drop bar, further including mounting brackets respectively securing said motors on said transom, said brackets being characterized in that they can be mounted on either the right or left side of the drop bars with cam disposed in the same relative relation to the drop bar tabs and the alternate door unlocking means each comprise a bracket on which the lever is mounted, said bracket being mounted on said transom and characterized in that it can be mounted on either side of the drop bar with the lever disposed in operative relation to said drop bar pin.

10. In a security system as in claim 9 wherein each lever of the alternate door unlocking means has a concavely curved pin engaging surface at its out end and each lever may be rotated relative to its mounting bracket so that the pin engaging surface will face the drop bar pin whether the bracket is mounted on the right side or left side of the drop bar.

* * * * *